US006737018B2

(12) United States Patent
Ota et al.

(10) Patent No.: US 6,737,018 B2
(45) Date of Patent: May 18, 2004

(54) CORROSION-RESISTANT CHROMIUM STEEL FOR ARCHITECTURAL AND CIVIL ENGINEERING STRUCTURAL ELEMENTS

(75) Inventors: Hiroki Ota, Chiba (JP); Takumi Ujiro, Chiba (JP); Junichiro Hirasawa, Chiba (JP); Osamu Furukimi, Chiba (JP)

(73) Assignee: JFE Steel Corporation, Tokyo (JP)

( * ) Notice: Subject to any disclaimer, the term of this patent is extended or adjusted under 35 U.S.C. 154(b) by 33 days.

(21) Appl. No.: 10/046,158

(22) Filed: Jan. 16, 2002

(65) Prior Publication Data

US 2002/0155019 A1 Oct. 24, 2002

(30) Foreign Application Priority Data

Jan. 16, 2001 (JP) ..... 2001-007743
Jan. 16, 2001 (JP) ..... 2001-007744

(51) Int. Cl.[7] ..... C22C 38/04; C22C 38/06; C22C 38/18; C22C 38/40

(52) U.S. Cl. ..... 420/36; 420/104; 420/112; 420/119

(58) Field of Search ..... 420/104, 105, 420/106, 107, 108, 109, 110, 111, 112, 113, 114

(56) References Cited

U.S. PATENT DOCUMENTS 3,663,208 A * 5/1972 Kirby et al. ..... 420/38
4,919,885 A * 4/1990 Meyer et al. ..... 420/104
5,350,559 A * 9/1994 Miyazaki et al. ..... 420/36
6,123,897 A * 9/2000 Fujita et al. ..... 420/38

FOREIGN PATENT DOCUMENTS

JP 2000-192196 * 11/2000

* cited by examiner

*Primary Examiner*—Daniel Jenkins
(74) *Attorney, Agent, or Firm*—Young & Thompson

(57) ABSTRACT

A corrosion-resistant chromium steel for architectural and civil engineering structural elements, includes 0.0015 to 0.02 mass percent C, 0.0015 to 0.02 mass percent N, 0.1 to 1.0 mass percent Si, 0.1 to 3.0 mass percent Mn, more than 5 mass percent to less than 10 mass percent Cr, 0.01 to 3.0 mass percent Ni, 0.1 mass percent or less of Al, 0.05 mass percent or less of P, 0.03 mass percent or less of S, 0.01 to 1.0 mass percent Co, and the balance being Fe and incidental impurities. The steel has high long-term corrosion resistance and high weld-zone toughness. Preferably, the steel further includes 0.01 to 0.5 mass percent V and 0.001 to 0.05 mass percent W, the Cr content is in the range of more than 5 mass percent to less than 8 mass percent, and the Cr, V, and W contents are within a specified ratio.

10 Claims, 3 Drawing Sheets

CORROSION-RESISTANT CHROMIUM STEEL FOR ARCHITECTURAL AND CIVIL ENGINEERING STRUCTURAL ELEMENTS

BACKGROUND OF THE INVENTION

1. Field of the Invention

The present invention relates to corrosion-resistant chromium steels used in welded structural elements. In particular, the present invention relates to a corrosion-resistant chromium steel suitable for architectural and civil engineering structural elements which are used in obscure places of completed structures and which are not exposed to severe environments, unlike outer walls.

2. Description of the Related Art

Traditionally, plain steels such as SS400, high tensile strength steels such as SM490, and coated or plated materials thereof have been primarily used in architectural and civil engineering structural elements.

With trends towards large constructions and a greater diversity of designs, the applications of various steels and materials have recently begun to be studied.

In particular, materials are being selected in consideration of life cycle costs (LCC) in view of growing environmental concerns. For example, a requirement for house designing is a lifetime of over one hundred years.

A possible means of prolonging the lifetime of a structure is by increasing the thickness of the plating layer of plated steel sheets. Unfortunately, a thick plated layer is not suitable in practice for architectural structures that inevitably require welding because the plated layer requires a great labor for treatment of the welded portion after welding.

In such circumstances, a possible material for architectural and civil engineering structural elements is an Fe—Cr alloy which has high corrosion resistance, which substantially requires no maintenance expenses for rust prevention, and which can be easily recycled.

Typical chromium steels, namely, stainless steels are divided broadly into ferritic stainless steels such as SUS430, austenitic stainless steels such as SUS304, martensitic stainless steels such as SUS410, and duplex stainless steels such as SUS329.

Of these stainless steels, austenitic stainless steels excel in strength, corrosion resistance, weldability, toughness at weld portions, and versatility. Thus, attempts have been made to apply austenitic stainless steels to architectural and civil engineering structural elements.

Austenitic stainless steels, however, have the following drawbacks:

(1) The steel is extremely expensive compared with plain steels because of the high content of alloying elements such as nickel and chromium;

(2) The steel is highly susceptible to stress corrosion cracking; and (3) The steel has a large thermal expansion coefficient and a small thermal conductivity, which cause ready accumulation of stress due to welding heat and are not suitable for the application of the steel to high-precision components.

Accordingly, it is difficult to use austenitic stainless steels in general-purpose structural elements as substitutions for plain steels or coated or plated plain steels.

Applications of low-chromium steels and in particular martensitic stainless steels to architectural and civil engineering structural elements have recently been examined as substitutions for coated or plated plain steels.

Martensitic stainless steels are exceptionally inexpensive compared with austenitic stainless steels containing large amounts of expensive nickel, have a low thermal expansion coefficient and high thermal conductivity, and have significantly high corrosion resistance and high strength compared with plain steels.

Furthermore, the martensitic stainless steels do not cause σ-embrittlement and 475° C.-embrittlement, which are inherent in high-chromium steels, and stress-corrosion cracking in chloride environments, which is inherent in austenitic stainless steels.

However, the martensitic stainless steels such as SUS410 steel have high carbon contents of about 0.1 mass percent and thus exhibit low toughness and poor workability in the weld zone. In addition, the martensitic stainless steels require preheating for welding, which results in poor welding efficiency. Thus, known martensitic stainless steels are not suitable for applications which require welding.

For example, Japanese Examined Patent Publication No. 51-13463 discloses a martensitic stainless steel for welded structural elements. This martensitic stainless steel contains 10 to 18 mass percent Cr, 0.1 to 3.4 mass percent Ni, 1.0 mass percent or less of Si, and 4.0 mass percent or less of Mn. The C content is reduced to 0.03 mass percent or less and the N content is reduced to 0.02 mass percent or less to form a massive martensitic structure at the welded heat affected zone.

Japanese Examined Patent Publication No. 57-28738 discloses another martensitic stainless steel for welded structural elements having high toughness and high workability at the weld zone. This martensitic stainless steel contains 10 to 13.5 mass percent Cr, 0.5 mass percent or less of Si, and 1.0 to 3.5 mass percent Mn. Both the C content and the N content are reduced to 0.020 mass percent or less and the Ni content is reduced to less than 0.1 mass percent to eliminate the necessity of preheating and postheating for welding.

It is preferable that the chromium content in the structural steel be higher in view of corrosion resistance. However, in general, many structural steels used do not always require significantly high corrosion resistance, for example, no rusting. In particular, structural elements which are used in obscure places of completed structures and which are not exposed to severe environments require only moderate corrosion resistance so that no rust fluid flows out, for long term use. In other words, these structural elements do not require the high corrosion resistance of known stainless steels.

Furthermore, it is preferable that hot-rolled steel sheets or descaled hot-rolled steel sheets be used in architectural and civil engineering structural elements from economical standpoint because high-quality surface properties are not necessary for these elements.

In order satisfy the above requirements, inexpensive chromium steels are currently being developed by reducing the chromium content to less than 10 mass percent under condition that hot-rolled or descaled hot-rolled steel sheets are used without further treatment.

For example, Japanese Patent No. 3039630 discloses a low-corrosion-rate steel for architectural structural elements. The steel contains 6 to 18 mass percent Cr, 0.05 to 1.5 mass percent Si, and 0.05 to 1.5 mass percent Mn. The C content is controlled within the range of 0.005 to 0.1 mass percent. The finishing delivery temperature during hot rolling is controlled to 780° C. or less to suppress local corrosion by intentionally forming of a chromium depletion layer with a thickness of at least 5 μm right below the oxide scale.

Japanese Unexamined Patent Publication No. 11-323505 discloses a steel containing 5 to 10 mass percent Cr, 0.05 to 1.0 mass percent Si, and 0.05 to 2.0 mass percent Mn. Both the C content and the N content in the steel are reduced to 0.005 to 0.03 mass percent. The Cr content at a depth in the range of 0.5 to 10 $\mu$m from the topmost surface of the metal portion is reduced to less than 5 mass percent to generate uniform entire corrosion, so that a local and significant decrease in thickness is reduced. As a result, a decrease in strength and destruction due to corrosion are suppressed.

In these technologies disclosed in Japanese Patent No. 3039630 and Japanese Unexamined Patent Publication No. 11-323505, however, a low-chromium steel containing less than 10 mass percent Cr does not have a sufficient corrosion resistance. Further improvement in long-term corrosion resistance is thereby required.

Furthermore, the technology disclosed in Japanese Unexamined Patent Publication No. 11-323505 is aimed at cladding, thermal spray coating, and plating procedures. Thus, this technology has a problem of high production costs.

The present inventors have developed Fe—Cr alloys having excellent weldability and high initial corrosion resistance without a significant increase in Ni, Cu, Cr, and Mo content, the addition of Nb and Ti, nor a marked decrease in C and N, and have filed Japanese Patent Application Nos. 2000-161626 and 2000-161627.

Specifically, the Fe—Cr alloy contains more than 8 mass percent to less than 15 mass percent Cr, 0.01 mass percent to less than 0.5 mass percent Co, 0.01 mass percent to less than 0.5 mass percent V, and 0.001 mass percent to less than 0.05 mass percent W. Moreover, the composition is adjusted so that a X value is 11.0 or less and a Z value is in the range of 0.03 to 1.5, wherein $$X\text{ value}=\text{Cr}+\text{Mo}+1.5\text{Si}+0.5\text{Nb}+0.2V+0.3\ W+8\text{Al}-\text{Ni}-0.6\text{Co}-0.5\text{Mn}-30\text{C}-30\text{N}-0.5\text{Cu}$$

$$Z\text{ value}=\text{Co}+1.5V+4.8W$$

Preferably, the composition is adjusted so that the ratio C/N is 0.6 or less.

However, this alloy containing a large amount of Cr has an economic disadvantage. In addition, a steel containing about 11 mass percent or more of Cr must be annealed for softening, making the economic disadvantage more marked. Although a steel containing more Cr is resistant to corrosion in long-term use, local corrosion readily occurs. Such localized corrosion is more disadvantageous to strength than uniform corrosion.

SUMMARY OF THE INVENTION

An object of the present invention is to provide an inexpensive corrosion-resistant chromium steel which has a low Cr content of less than 10 mass percent, which has a lifetime of at least 100 years in structural welding applications where excellent appearance is not required, and which can be used as a hot-rolled or descaled hot-rolled state without further treatment. Such a steel is suitable for architectural and civil engineering structural elements which are used in obscure places of completed structures and which are not exposed to severe environments.

The steel of the invention has a structure substantially composed of a single ferritic phase after hot rolling, a tensile strength TS of 400 to 550 MPa, and a decrease in strength due to corrosion of 10% or less and preferably 5% or less after use for 100 or more years as architectural and civil engineering structural elements compared with the strength before use.

Furthermore, in the steel of the invention, the heat-affected zone is substantially composed of a martensitic structure to suppress the formation of coarse grains, which cause deterioration of toughness at the weld zone.

The steel of the invention can be formed into steel pipes and section steels by welding and shaping and be used in structural elements.

According to an aspect of the invention, a corrosion-resistant chromium steel for architectural and civil engineering structural elements, comprises from about 0.0015 to about 0.02 mass percent C, from about 0.0015 to about 0.02 mass percent N, from about 0.1 to about 1.0 mass percent Si, from about 0.1 to about 3.0 mass percent Mn, more than about 5 mass percent to less than about 10 mass percent Cr, from about 0.01 to about 3.0 mass percent Ni, about 0.1 mass percent or less of Al, about 0.05 mass percent or less of P, about 0.03 mass percent or less of S, from about 0.01 to about 1.0 mass percent Co, and the balance being Fe and incidental impurities, the steel thereby having high long-term corrosion resistance and high weld-zone toughness.

Preferably, the steel further comprises from about 0.01 to about 0.5 mass percent V and from about 0.001 to about 0.05 mass percent W, the Cr content is in the range of more than about 5 mass percent to less than about 8 mass percent, and a Z value represented by formula (1) is in the range of 0.03 to 1.5:

$$Z\text{ value}=([\%\text{Co}]+1.5[\%V]+4.8[\%W]) \quad (1)$$

wherein [%Co], [%V], [%W], respectively, represent Co, V, and W contents by mass percent.

Preferably, the Cr content is in the range of more than about 5 mass percent to less than about 7.5 mass percent and the W content is in the range of from about 0.001 to about 0.03 mass percent.

Preferably, the steel further comprises at least one of about 3.0 mass percent or less of Cu and about 3.0 mass percent or less of Mo.

Preferably, the steel further comprises from about 0.0002 to about 0.0030 mass percent of B.

DESCRIPTION OF THE PREFERRED EMBODIMENTS

The present inventors have intensively investigated the effects of various elements in order to achieve the object of the present invention. In particular, the effects of Co, V, and W on rusting have been examined using low-chromium steels containing less than 10 mass percent Cr.

As a result, the inventors have found that an optimum amount of Co contributes to an outstanding improvement in weld-zone toughness and that optimization of the contents of these three elements contributes to an significant improvement in long-term corrosion resistance without significantly increased Ni, Cu, Cr, and Mo contents, and without increased production costs due to the addition of Nb and Ti and reduction in C and N.

Experimental results performed for accomplishing the present invention will now be described.

The effect of the addition of cobalt on a low-chromium steel will be described.

Figure 1:
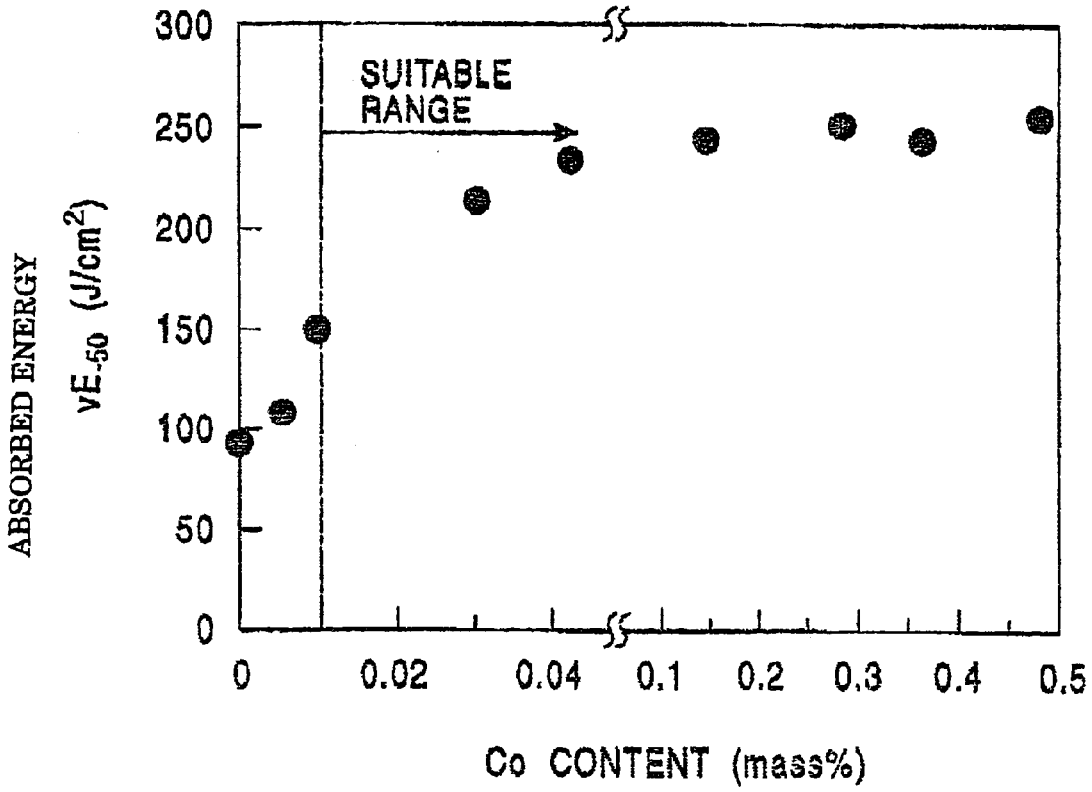
FIG. 1 is a graph illustrating the effect of the Co content on the weld-zone toughness.

FIG. 1 is a graph illustrating the effect of the Co content on the weld-zone toughness in a chromium steel containing 7 mass percent Cr.

Figure 2:
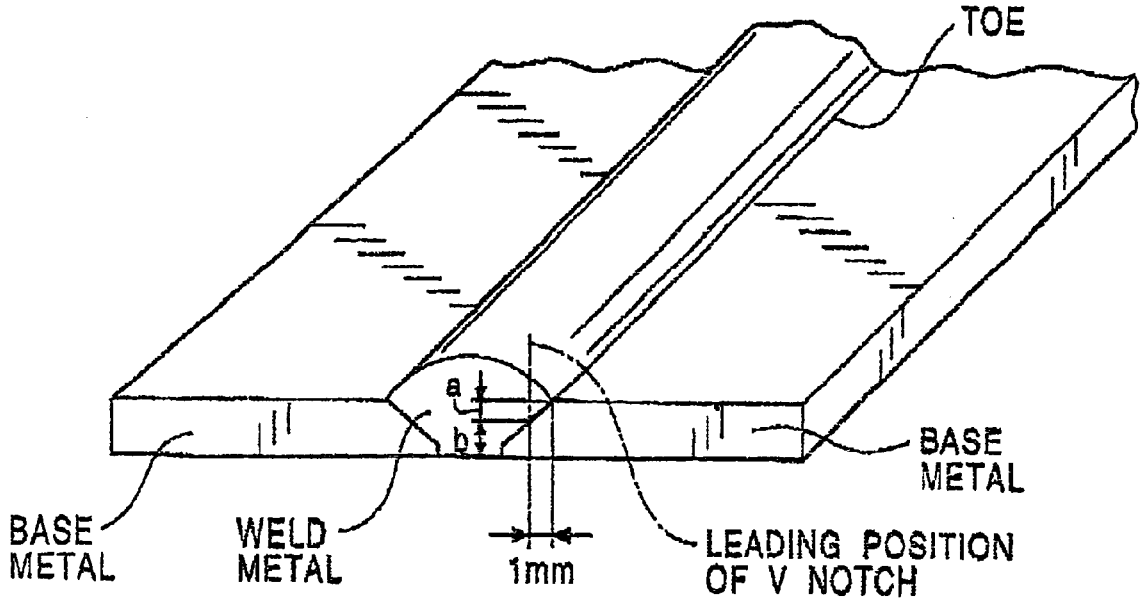
FIG. 2 is a schematic view illustrating the relationship between the leading position of a V notch of a Charpy test piece and the weld zone.

The weld-zone toughness is evaluated as follows. A square groove is prepared for the welding with its welding direction, perpendicular to the rolled direction, from a hot-rolled steel sheet with a thickness of 5.5 mm. Two steel sheets are welded with a semiautomatic MAG welding machine using a welding wire, type Y309L, with a diameter of 1.2 mm to form a welded joint. As shown in FIG. 2, a Charpy test piece with a 2-mm V notch (Japanese Industrial Standard (JIS) Z 2202) and a subsize width of 5 mm (corresponding to the thickness of the sheet) is sampled so that the leading portion of the V notch lies at a position 1 mm from the toe towards the welding metal. The absorption energy at −50° C. is measured. The ratio a:b of the welding metal to the base metal at the leading portion of the V notch is 1:4.

FIG. 1 shows that the weld-zone toughness is enhanced by the addition of 0.01 mass percent or more of Co and is significantly enhanced by the addition of 0.03 mass percent or more of Co.

The effect of combined use of Co, V, and W will now be described.

Figure 3:
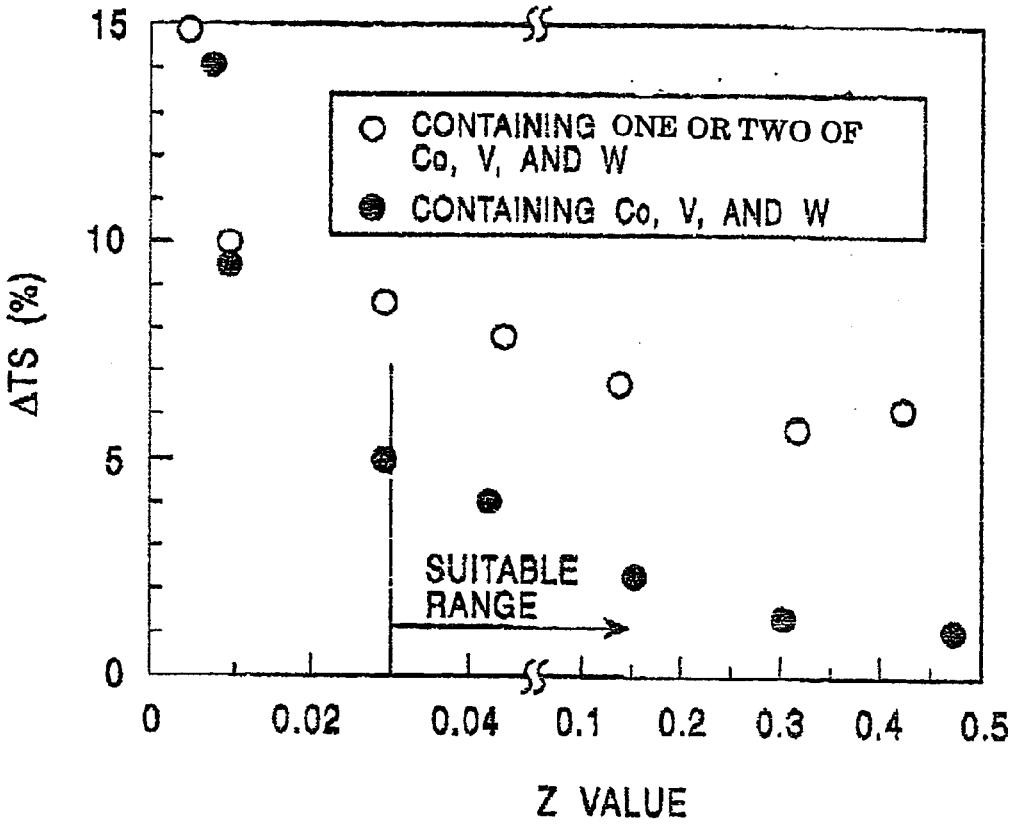
FIG. 3 is a graph illustrating the relationship between the decrease in strength due to long-term corrosion and the Z value.

FIG. 3 is a graph illustrating the relationship between the decrease in strength due to long-term corrosion and the Z value in a chromium steel containing 7 mass percent Cr wherein the Z value is a parameter representing the effects of these three elements and is represented by formula (1):

$$Z=([\%Co]+1.5[\%V]+4.8[\%W]) \quad (1)$$

wherein [%Co], [%V], [%W], respectively, represent Co, V, and W contents by mass percent.

The decrease in strength is evaluated as follows. A 4-mm thick hot-rolled steel sheet is subjected to a 300-cycle corrosion resistance test, each cycle including salt spraying (0.1% NaCl, 35° C., 3 hours), drying (60° C., 3hours), and wetting (50° C., 2 hours). The decrease in maximum tensile strength after testing compared to the strength of the untreated sheet is determined.

FIG. 3 also includes the results of compositions containing one or two of these elements Co, V, and W for comparison.

FIG. 3 shows that the decrease in strength due to long-term corrosion sharply decreases at a Z value of 0.03 or more, demonstrating a significant increase in long-term corrosion resistance. The effect of the combined use of the three elements is outstanding compared with the other compositions not containing all of the three elements.

Next, the reasons for the limitation of the composition in the invention will now be described.

C: from about 0.0015 to about 0.02 mass percent and N: from about 0.0015 to about 0.02 mass percent.

It is preferable that the C and N be reduced as much as possible to improve workability at the welded heat affected zone and to prevent weld cracking. Excess amounts of these elements cause excessively high strength of the hot-rolled sheet. Furthermore, C and N affect the hardness of the martensitic phase in the welded heat affected zone and promote the formation of Cr depletion layer due to precipitation of carbonitrides, resulting in deterioration of corrosion resistance. Thus, the upper limits of the C and N contents must be about 0.02 mass percent. An excess reduction in C and N content causes increased refining costs and low strength of the hot rolled sheet. Furthermore, the martensitic phase in the welded heat affected zone is not sufficiently formed, promoting the formation of coarse ferritic grains which cause deterioration of toughness at the welded heat affected zone. Thus, the lower limits of the C and N contents are about 0.0015 mass percent. Preferably, both the C and N contents are in the range of from about 0.0020 to about 0.010 mass percent.

Si: from about 0.1 to about 1.0 mass percent

Silicon (Si) functions as a deoxidizing agent if the Si content is about 0.1 mass percent or more. However, a Si content exceeding about 1.0 mass percent decreases toughness and workability and decreases the formation of the martensitic phase in the welded heat affected zone. Thus, the Si content is in the range of from about 0.1 to about 1.0 mass percent and preferably from about 0.1 to about 0.5 mass percent.

Mn: from about 0.1 to about 3.0 mass percent

Manganese (Mn) stabilizes the austenitic phase, increases the formation of the martensitic phase in the welded heat affected zone, increases toughness, and functions as a deoxidizing agent, if the Mn content is about 0.1 mass percent or more. However, a Mn content exceeding about 3.0 mass percent decreases workability and corrosion resistance due to the formation of MnS. Thus, the Mn content is in the range of from about 0.1 to about 3.0 mass percent and preferably from about 0.1 to about mass percent.

Cr: more than about 5 mass percent to less than about 10 mass percent

Chromium (Cr) improves corrosion resistance. Although the invention does not postulate the use of the steel in severe environments, for example, as outer walls, the rust liquid must not drip down during long-term use in mild environments and in obscure places of completed structures.

Thus, Cr must be added in an amount of exceeding about 5 mass percent to ensure corrosion resistance. In the inexpensive chromium steel according to the invention, a Cr content exceeding about 10 mass percent is disadvantageous to material costs. Thus, the Cr content is in the range of more than about 5 mass percent to less than about 10 mass percent. In the case of combined use of Co, V, and W, the Cr content is preferably in the range of more than about 5 mass percent to less than about 8 mass percent to effectively decrease localized corrosion. In a more preferable embodiment, the Cr content is preferably in the range of more than about 5 mass percent to less than about 7.5 mass percent and the W content is in the range of from about 0.005 to about 0.03 mass percent. In such an optimized composition, localized corrosion is effectively suppressed, and a decrease in the strength can be suppressed for long term use.

Ni: from about 0.01 to about 3.0 mass percent

Nickel (Ni) improves ductility and toughness of the steel. In the invention, nickel is added to improve the toughness at the weld zone. At least about 0.01 mass percent nickel must be added to ensure the improvement in toughness. However, a Ni content exceeding about 3.0 mass percent causes deterioration of workability due to hardening of the steel, in addition to the saturation of the improvement in toughness. Thus, the Ni content is in the range of from about 0.01 to about 3.0 mass percent.

Al: about 0.1 mass percent or less

Although aluminum (Al) functions as a deoxidizing agent, a large amount of aluminum in the steel causes an increase in oxide inclusion, resulting in nozzle clogging in the steel making process and surface defects such as scab. Thus, the Al content is about 0.1 mass percent or less.

P: about 0.05 mass percent or less

Phosphorus (P) induces cracking during hot working and precludes corrosion resistance. These adverse affects are negligible if the P content does not exceed about 0.05 mass percent. Thus, the P content is about 0.05 mass percent or less and preferably about 0.03 mass percent or less.

S: about 0.03 mass percent or less

Sulfur (S) decreases the purity of the steel due to the formation of sulfides and induces rusting due to the formation of MnS. Furthermore, sulfur is segregated at the crystal grain boundaries and induces grain boundary embrittlement. Thus, sulfur is reduced as much as possible. However, these adverse affects are negligible if the S content does not exceed about 0.03 mass percent.

Co: from about 0.01 to about 1.0 mass percent

Cobalt (Co) is an essential element in the invention. A small amount of Co significantly improves the weld-zone toughness of a low-chromium steel containing less than about 10 mass percent Cr. Cobalt also improves long-term corrosion resistance compared with a cobalt-free composition. The effect of Co is noticeable at a content of at least about 0.01 mass percent. However, a Co content exceeding about 1.0 mass percent causes hardening of the steel, resulting in less workability. Hence, the Co content is in the range of from about 0.01 to about 1.0 mass percent and more preferably from about 0.03 to about 1.0 mass percent.

The improvement in weld-zone toughness by the addition of Co is considered to be for the following reasons. A martensitic phase is readily formed in the welded heat affected zone due to an increase in the formation of the austenitic phase by Co adding, and hardening of the martensite phase is moderated compared with that by adding C and N.

The mechanism of the improvement in long-term corrosion resistance by Co is not clear. As a possible mechanism, Co which is concentrated in the surface or scales of the steel causes uniform corrosion on the entire surface so as to prevent acute localized corrosion as a main cause of decreased strength.

$$Z \text{ value } ([\%Co]+1.5[\%V]+4.8[\%W]): 0.03 \text{ to } 1.5$$

Cobalt (Co), vanadium (V), and tungsten (W) are the most important elements in the invention. Traditionally, optimizations of $P_{CM}\{=C+Si/30+(Mn+Cu+Cr)/20+Ni/60+Mo/15+V/10+5B\}$, the Ni equivalent, and the Cr equivalent have been investigated to improve sensitivity to weld cracking in the welded heat affected zone. Thus, investigations regarding Cr, Mo, and Ni which significantly affects these parameters and C, N, Nb, and Ti have been performed in order to improve the properties of the welded heat affected zone, the corrosion resistance, the ductility, and the workability.

In contrast, the effects of Co and W on the parameters such as $P_{CM}$/ Ni equivalent, and Cr equivalent, and on the long-term corrosion resistance of hot-rolled or descaled hot-rolled steel sheets have not been investigated intensively, though these elements affects the corrosion resistance and the stability of the ferritic and austenitic phases.

In the invention, the effects of Co, V, and W on the long-term corrosion resistance of hot-rolled or descaled hot-rolled steel sheets and particularly the effects of combined use of these elements are quantitatively evaluated to determine the optimized composition.

The Z value representing the proportion of these elements is an index of the long-term corrosion resistance. As described above, Co, V, and W are used in combination so that the Z value is at least 0.03. The steel sheet thereby has a desired long-term corrosion resistance.

The mechanism of the improvement in long-term corrosion resistance by these three elements is not clear. As a possible mechanism, Co, V, and W which are concentrated in the surface or scales of the steel cause uniform corrosion on the entire surface so as to prevent acute localized corrosion as a main cause of decreased strength.

A Z value exceeding 1.5 precludes the workability of the steel due to hardening, in addition to the saturation of the improvement in the long-term corrosion resistance.

Thus, the Z value is in the range of 0.03 to 1.5 and more preferably 0.05 to 1.0.

V: from about 0.01 to about 0.5 mass percent and W: from about 0.001 to about 0.05 mass percent The V content is in the range of from about 0.01 to about 0.5 mass percent and the W content is in the range of from about 0.001 to about 0.05 mass percent to ensure the above effects. At a V or W content of less than the above lower limit, the combined use of above mentioned three elements has no effect on the long-term corrosion resistance even when the Z value is in the above range (0.03 to 1.5). When the V content or the W content exceeds the above upper limit, the toughness of the base metal and the welded heat affected zone significantly decrease due to marked precipitation of carbides. Preferably, the V content is in the range of from about 0.05 to about 0.3 mass percent and the W content is in the range of from about 0.005 to about 0.03 mass percent.

In the invention, as described above, the toughness of the welded heat affected zone is improved by the addition of Co to a low-chromium steel, and the long-term corrosion resistance is improved by the combined use of Co, V, and W. Thus, both the toughness of the weld zone and the tong-term corrosion resistance of a hot-rolled or descaled hot-rolled steel are achieved without increased costs, namely, without noticeable increases in contents of expensive elements such as Ni, Cu, Cr, and Mo, addition of Nb and Ti, and decreases in C and N.

The essential elements and reduced elements in the invention have been described above. The following elements may be added in the invention.

Cu: about 3.0 mass percent or less

Copper (Cu) is a corrosion-resistant element and is effectively added to steel which requires high corrosion resistance. The effect of copper is noticeable in an amount of at least about 0.01 mass percent. A Cu content exceeding about 3.0 mass percent may cause brittleness or cracking during hot rolling. Thus, the upper limit of the Cu content is about 3.0 mass percent. Preferably, the Cu content is in the range of from about 0.1 mass percent to about 1.0 mass percent.

Mo: about 3.0 mass percent or less

Molybdenum (Mo) also improves corrosion resistance of the steel when an amount of at least about 0.01 mass percent is added. A Mo content exceeding about 3.0 mass percent decreases the workability and the toughness of the welded heat affected zone due to the decreased stability of the austenitic phase. Thus, the upper limit of the Mo content is about 3.0 mass percent. Preferably, the Mo content is in the range of from about 0.1 to about 1.0 mass percent in view of compatibility between the workability and the corrosion resistance.

B: from about 0.0002 to about 0.0030 mass percent

Boron (B) particularly contributes to an improvement in the toughness of the welded heat affected zone due to improved hardenability if an amount of at least about 0.0002 mass percent is added. A boron content exceeding about 0.0030 mass percent causes excess hardening of the steel, resulting in deterioration of toughness and workability of both the base metal and the welded heat affected zone.

Thus, the B content is in the range of from about 0.0002 to about 0.0030 mass percent and preferably from about 0.0005 to about 0.0010 mass percent.

A preferable method for making the steel according to the invention will now be described.

Using a molten steel having the optimized composition, an ingot is formed in a converter or an electric furnace. The ingot is refined by a known refinery process, for example, an RH process (vacuum degassing), a VOD process, or an AOD process. The ingot is cast into a slab by a continuous casting process or an ingot making/blooming process.

The steel slab is hot-rolled into a desired shape, for example, a steel sheet, a section steel, or a steel bar. Although the heating temperature during the hot rolling is not limited, an excess heating temperature causes coarsening of the crystal grains. Such coarsening may result in cracking during hot rolling due to the formation of δ-ferrite, in addition to deterioration of toughness and workability. Thus, the preferable heating temperature is in the range of about 1,000 to 1,300° C. The hot rolling conditions are not limited as long as the steel has a target thickness and size. The preferable finishing delivery temperature during the hot rolling is in the range of 800 to 1,100° C. in view of production efficiency.

The hot-rolled steel can be subjected to descaling by shot blasting or pickling to yield a final product. A rust preventive agent may be applied to the surfaces of the hot-rolled or descaled hot-rolled steel, if necessary. Furthermore, the hot-rolled steel may be annealed in a batch or continuous furnace held at 600 to 900° C. to soften the steel. The descaled steel can be cold-rolled at a low reduction rate (temper-rolled) to harden the surface, to decrease the surface roughness, or to impart glossiness to the surface.

The steel product can be used as structural steels without additional treatment or may be used after shaping into square and cylindrical pipes and various section steels.

EXAMPLE 1

Molten steels having compositions shown in Table 1, molten steels were prepared in a converter followed by secondary refining, and then slabs were prepared by continuous casting. Each slab was hot-rolled to form a hot-rolled steel sheet having a thickness of 4 mm and a hot-rolled steel sheet having a thickness of 5.5 mm. The heating temperature of the slab was 1,100° C. to 1,200° C., the finishing delivery temperature was 800 to 1,050° C., and the coiling temperature was 600 to 900° C. Parts of the resulting hot-rolled steel sheets were subjected to descaling.

Test pieces were prepared from these hot-rolled steel sheets to measure the tensile strength, elongation, long-term corrosion resistance, and weld-zone toughness as follows.

(1) Tensile Strength and Elongation

A JIS No. 13-B test piece (JIS Z 2201) was prepared from each hot-rolled or descaled hot-rolled steel sheet with a thickness of 4 mm so that the stretching direction was parallel to the rolling direction, and was subjected to a tensile test to determine the elongation (EL) and the tensile strength (TS).

(2) Long-Term Corrosion Resistance

Each hot-rolled or descaled hot-rolled steel sheet having a thickness of 4 mm was subjected to a 300-cycle corrosion resistance test, each cycle including salt spraying (0.1% NaCl, 35° C., 3 hours), drying (60° C., 3 hours), and wetting (50° C., 2 hours). The results of this test correspond to the corrosion resistance after the steel sheet is used for 100 years. A JIS No. 13-B test piece was prepared from the tested steel sheet so that the stretching direction was parallel to the rolling direction, and was subjected to a tensile test to determine the decrease in tensile strength due to corrosion based on the following equation:

$$\Delta TS=[(P_{max}{}^{0}-P_{max})/P_{max}{}^{0}]\times 100(\%)$$

wherein $P_{max}{}^{0}$ is the maximum load of the uncorroded steel sheet during tensile test, and $P_{max}$ is the maximum load of the corroded steel sheet during tensile test.

(3) Weld-Zone Toughness

A square groove was prepared for the welding section with its welding direction, perpendicular to the rolled direction, from a hot-rolled or descaled hot-rolled steel sheet with a thickness of 5.5 mm. Two steel sheets were welded by one pass with a semiautomatic MAG welding machine using a welding wire, type Y309L, with a diameter of 1.2 mm to form a welded joint. The welding conditions were as follows: atmospheric gas: Ar (flow rate: 15 liter/min)+$CO_2$ (flow rate: 4 liter/min); voltage: 20 to 30 V, current: 200 to 250 A, gap: 2 to 3 mm; welding speed: 30 to 60 cm/min.

As shown in FIG. 2, a Charpy test piece with a 2-mm V notch (JIS Z 2202) and a subsize width of 5 mm (corresponding to the thickness of the sheet) was sampled so that the leading portion of the V notch lay at a position 1 mm from the toe towards the welding metal. The absorption energy at −50° C. was measured. The ratio a:b of the welding metal to the base metal at the leading portion of the V notch was about 1:4. The results are shown in Table 2.

Table 2 shows that the examples having the compositions within the scope of the invention exhibit high weld-zone toughness and a small decrease in tensile strength of 10 percent or less when the steel sheet is used for 100 years, suggesting high long-term corrosion resistance.

In contrast, the comparative examples exhibit low weld-zone toughness and low long-term corrosion resistance.

EXAMPLE 2

Using molten steels having compositions shown in Table 3, hot-rolled steel sheets were prepared as in Example 1. Test pieces were prepared from these hot-rolled steel sheets to measure the tensile strength, elongation, long-term corrosion resistance, and weld-zone toughness as in Example 1. The results are shown in Table 4.

Table 4 shows that the examples having the compositions within the scope of the invention exhibit high weld-zone toughness and a small decrease in tensile strength of 5 percent or less when the steel sheet is used for 100 years, suggesting extremely high long-term corrosion resistance.

In contrast, the comparative examples exhibit low weld-zone toughness and low long-term corrosion resistance.

As described above, the chromium steel according to the invention exhibits high workability and high weld-zone toughness. Furthermore, high long-term corrosion resistance is achieved under condition that hot-rolled or descaled hot-rolled steel sheets are used without further treatment.

Since the chromium steel according to the invention is inexpensive, the steel can be used as architectural and civil engineering structural elements. Furthermore, these elements can be used for long terms due to high long-term corrosion resistance.

TABLE 1

| Steel | Composition (mass %) C | Si | Mn | P | S | Al | Cr | Ni | N | Mo | Cu | B | Co | Remarks |
|---|---|---|---|---|---|---|---|---|---|---|---|---|---|---|
| A | 0.0049 | 0.20 | 1.37 | 0.032 | 0.006 | 0.002 | 7.55 | 0.21 | 0.0040 | — | — | — | 0.057 | example |
| B | 0.0020 | 0.28 | 1.10 | 0.022 | 0.005 | 0.011 | 9.96 | 0.44 | 0.0020 | — | — | — | 0.035 | of this |
| C | 0.0146 | 0.98 | 0.10 | 0.028 | 0.008 | 0.056 | 5.27 | 0.03 | 0.0022 | — | — | — | 0.140 | invention |
| D | 0.0021 | 0.80 | 0.12 | 0.031 | 0.005 | 0.080 | 5.08 | 0.02 | 0.0148 | — | — | — | 0.050 | |
| E | 0.0051 | 0.11 | 0.30 | 0.009 | 0.001 | 0.007 | 8.90 | 0.24 | 0.0047 | — | — | — | 0.102 | |
| F | 0.0060 | 0.15 | 1.42 | 0.027 | 0.005 | 0.005 | 6.58 | 0.08 | 0.0062 | — | — | — | 0.350 | |
| G | 0.0040 | 0.21 | 1.57 | 0.030 | 0.008 | 0.001 | 7.97 | 0.30 | 0.0045 | — | — | 0.0005 | 0.020 | |
| H | 0.0028 | 0.25 | 2.95 | 0.027 | 0.006 | 0.005 | 5.08 | 0.02 | 0.0025 | — | — | — | 0.982 | |
| I | 0.0055 | 0.26 | 1.29 | 0.030 | 0.008 | 0.009 | 5.04 | 0.95 | 0.0050 | — | — | — | 0.044 | |
| J | 0.0048 | 0.32 | 1.00 | 0.025 | 0.004 | 0.001 | 6.22 | 0.25 | 0.0044 | 1.05 | 0.18 | — | 0.080 | |
| K | 0.0046 | 0.20 | 0.78 | 0.030 | 0.005 | 0.004 | 6.88 | 0.24 | 0.0035 | — | 0.55 | — | 0.066 | |
| L | 0.0050 | 0.15 | 1.24 | 0.027 | 0.006 | 0.022 | 6.30 | 0.31 | 0.0040 | 0.53 | — | — | 0.151 | |
| M | 0.0027 | 0.20 | 1.05 | 0.048 | 0.028 | 0.004 | 5.18 | 0.08 | 0.0025 | 2.92 | — | — | 0.013 | |
| N | 0.0028 | 0.31 | 1.20 | 0.029 | 0.006 | 0.005 | 5.10 | 0.06 | 0.0022 | — | 2.77 | — | 0.304 | |
| O | 0.0068 | 0.26 | 1.33 | 0.030 | 0.005 | 0.006 | 4.18 | 0.35 | 0.0064 | — | — | — | 0.055 | comparative |
| P | 0.0225 | 0.20 | 1.54 | 0.028 | 0.007 | 0.006 | 7.95 | 0.33 | 0.0215 | — | — | — | 0.142 | example |
| Q | 0.0048 | 0.17 | 1.49 | 0.031 | 0.005 | 0.005 | 7.63 | 0.25 | 0.0040 | — | — | — | 0.008 | |

TABLE 2

| No. | Steel | Descaling | Steel properties TS (MPa) | El (%) | Weld zone property $vE_{-50}$ (J/cm$^2$) | Long-term corrosion resistance ΔTS (%) | Remarks |
|---|---|---|---|---|---|---|---|
| 1 | A | Not performed | 505 | 32.8 | 240 | 7.2 | example |
| 2 | | Performed | 510 | 33.0 | 240 | 6.4 | of this |
| 3 | B | Not performed | 421 | 41.2 | 235 | 5.8 | invention |
| 4 | | Performed | 420 | 41.0 | 230 | 5.2 | |
| 5 | C | Not performed | 546 | 31.4 | 228 | 9.9 | |
| 6 | D | Not performed | 540 | 32.0 | 220 | 9.7 | |
| 7 | E | Not performed | 461 | 37.8 | 238 | 6.0 | |
| 8 | F | Not performed | 434 | 39.0 | 240 | 5.4 | |
| 9 | G | Not performed | 530 | 32.7 | 200 | 8.8 | |
| 10 | H | Not performed | 550 | 31.4 | 234 | 8.0 | |
| 11 | I | Not performed | 405 | 40.7 | 220 | 8.5 | |
| 12 | | Performed | 410 | 40.7 | 220 | 7.4 | |
| 13 | J | Not performed | 534 | 32.6 | 238 | 5.9 | |
| 14 | K | Not performed | 511 | 33.0 | 235 | 7.2 | |
| 15 | L | Not performed | 520 | 34.0 | 230 | 6.0 | |
| 16 | M | Not performed | 494 | 34.3 | 174 | 7.0 | |
| 17 | N | Not performed | 439 | 38.9 | 240 | 5.9 | |
| 18 | O | Not performed | 410 | 39.0 | 208 | 11.8 | comparative |
| 19 | | Performed | 410 | 39.0 | 208 | 11.0 | example |
| 20 | P | Not performed | 662 | 22.1 | 150 | 14.8 | |
| 21 | Q | Not performed | 516 | 33.0 | 110 | 13.4 | |

TABLE 3

| Steel | Composition (mass %) C | Si | Mn | P | S | Al | Cr | Ni | N | Mo | Cu | B | Co | V | W | Z value | Remarks |
|---|---|---|---|---|---|---|---|---|---|---|---|---|---|---|---|---|---|
| a | 0.0050 | 0.20 | 1.35 | 0.030 | 0.005 | 0.002 | 7.64 | 0.19 | 0.0042 | — | — | — | 0.054 | 0.093 | 0.005 | 0.22 | example |
| b | 0.0020 | 0.28 | 1.05 | 0.021 | 0.004 | 0.010 | 7.97 | 0.51 | 0.0020 | — | — | — | 0.223 | 0.084 | 0.008 | 0.39 | of this |
| c | 0.0148 | 0.96 | 0.10 | 0.032 | 0.007 | 0.060 | 5.31 | 0.03 | 0.0022 | — | — | — | 0.020 | 0.153 | 0.010 | 0.30 | invention |
| d | 0.0023 | 0.84 | 0.12 | 0.030 | 0.005 | 0.086 | 5.14 | 0.02 | 0.0147 | — | — | — | 0.053 | 0.031 | 0.006 | 0.13 | |
| e | 0.0053 | 0.12 | 0.30 | 0.010 | 0.001 | 0.008 | 7.51 | 0.30 | 0.0057 | — | — | — | 0.141 | 0.076 | 0.003 | 0.27 | |
| f | 0.0062 | 0.15 | 1.40 | 0.020 | 0.005 | 0.004 | 6.77 | 0.09 | 0.0060 | — | — | — | 0.321 | 0.141 | 0.016 | 0.61 | |
| g | 0.0042 | 0.22 | 1.55 | 0.031 | 0.006 | 0.001 | 7.99 | 0.31 | 0.0043 | — | — | 0.0005 | 0.014 | 0.494 | 0.049 | 0.99 | |
| h | 0.0028 | 0.24 | 2.97 | 0.029 | 0.007 | 0.005 | 5.11 | 0.02 | 0.0030 | — | — | — | 0.970 | 0.094 | 0.005 | 1.14 | |
| i | 0.0054 | 0.26 | 1.29 | 0.029 | 0.007 | 0.010 | 5.03 | 0.95 | 0.0050 | — | — | — | 0.041 | 0.197 | 0.040 | 0.53 | |
| j | 0.0044 | 0.33 | 0.90 | 0.022 | 0.004 | 0.004 | 6.02 | 0.23 | 0.0050 | 1.00 | 0.24 | — | 0.301 | 0.061 | 0.002 | 0.40 | |
| k | 0.0046 | 0.21 | 0.77 | 0.025 | 0.005 | 0.005 | 6.86 | 0.25 | 0.0040 | — | 0.51 | — | 0.032 | 0.105 | 0.020 | 0.29 | |
| l | 0.0051 | 0.20 | 1.12 | 0.031 | 0.005 | 0.024 | 6.24 | 0.33 | 0.0041 | 0.51 | — | — | 0.030 | 0.094 | 0.005 | 0.20 | |
| m | 0.0030 | 0.19 | 1.05 | 0.047 | 0.030 | 0.006 | 5.33 | 0.09 | 0.0028 | 2.90 | — | — | 0.011 | 0.011 | 0.003 | 0.04 | |
| n | 0.0027 | 0.27 | 1.24 | 0.030 | 0.006 | 0.001 | 5.10 | 0.04 | 0.0030 | — | 2.81 | — | 0.182 | 0.066 | 0.006 | 0.31 | |
| o | 0.0069 | 0.26 | 1.42 | 0.031 | 0.006 | 0.005 | 4.40 | 0.40 | 0.0063 | — | — | — | 0.051 | 0.074 | 0.005 | 0.19 | comparative |
| p | 0.0220 | 0.22 | 1.55 | 0.029 | 0.006 | 0.007 | 7.98 | 0.38 | 0.0214 | — | — | — | 0.036 | 0.151 | 0.036 | 0.44 | example |

TABLE 3-continued

| Steel | Composition (mass %) C | Si | Mn | P | S | Al | Cr | Ni | N | Mo | Cu | B | Co | V | W | Z value | Remarks |
|---|---|---|---|---|---|---|---|---|---|---|---|---|---|---|---|---|---|
| q | 0.0051 | 0.14 | 1.34 | 0.030 | 0.004 | 0.004 | 7.56 | 0.27 | 0.0055 | — | — | — | — | 0.052 | 0.020 | 0.17 | |
| r | 0.0049 | 0.17 | 1.50 | 0.028 | 0.005 | 0.002 | 7.69 | 0.18 | 0.0040 | — | — | — | 0.047 | 0.108 | — | 0.21 | |
| s | 0.0060 | 0.22 | 1.11 | 0.030 | 0.006 | 0.001 | 7.31 | 0.12 | 0.0030 | — | — | — | 0.028 | — | 0.011 | 0.08 | |

TABLE 4

| No. | Steel | Descaling | Steel properties TS (MPa) | El (%) | Weld zone property $vE_{-50}$ (J/cm$^2$) | Long-term corrosion resistance ΔTS (%) | Remarks |
|---|---|---|---|---|---|---|---|
| 1 | a | Not performed | 520 | 32.7 | 242 | 2.2 | example of this invention |
| 2 | | Performed | 516 | 32.6 | 240 | 1.6 | |
| 3 | b | Not performed | 430 | 40.8 | 240 | 1.2 | |
| 4 | | Performed | 435 | 40.5 | 245 | 0.9 | |
| 5 | c | Not performed | 550 | 31.0 | 180 | 3.0 | |
| 6 | d | Not performed | 548 | 31.4 | 215 | 4.4 | |
| 7 | e | Not performed | 457 | 37.4 | 240 | 1.3 | |
| 8 | f | Not performed | 430 | 39.6 | 230 | 0.8 | |
| 9 | g | Not performed | 544 | 30.8 | 190 | 1.0 | |
| 10 | h | Not performed | 540 | 31.5 | 230 | 4.0 | |
| 11 | i | Not performed | 414 | 40.1 | 220 | 2.8 | |
| 12 | | Performed | 413 | 40.0 | 220 | 2.4 | |
| 13 | j | Not performed | 540 | 32.0 | 242 | 2.0 | |
| 14 | k | Not performed | 522 | 33.1 | 205 | 1.4 | |
| 15 | l | Not performed | 505 | 34.4 | 200 | 1.7 | |
| 16 | m | Not performed | 495 | 33.8 | 160 | 3.0 | |
| 17 | n | Not performed | 427 | 39.0 | 240 | 2.0 | |
| 18 | o | Not performed | 417 | 38.8 | 220 | 5.6 | comparative example |
| 19 | | Performed | 417 | 38.8 | 220 | 5.4 | |
| 20 | p | Not performed | 684 | 21.0 | 215 | 7.8 | |
| 21 | q | Not performed | 518 | 32.0 | 100 | 7.9 | |
| 22 | r | Not performed | 528 | 30.4 | 230 | 7.2 | |
| 23 | s | Not performed | 515 | 32.6 | 180 | 8.0 | |

What is claimed is:

1. A corrosion-resistant chromium steel for architectural and civil engineering structural elements, comprising:

from about 0.0015 to about 0.02 mass percent C;

from about 0.0015 to about 0.02 mass percent N;

from about 0.1 to about 1.0 mass percent Si;

from about 0.1 to about 3.0 mass percent Mn;

more than about 5 mass percent to less than about 10 mass percent Cr;

from about 0.01 to about 0.95 mass percent Ni;

about 0.1 mass percent or less of Al;

about 0.05 mass percent or less of F;

about 0.03 mass percent or less of S;

from about 0.01 to about 1.0 mass percent Go; and the balance being Fe and incidental impurities, the steel thereby having high long-term corrosion resistance and high weld-zone toughness.

2. The corrosion-resistant chromium steel for architectural and civil engineering structural elements according to claim 1, further comprising:

from about 0.01 to about 0.5 mass percent V; and from about 0.001 to about 0.05 mass percent W, wherein the Cr content is in the range of more than about 5 mass percent to less than about 8 mass percent, and a Z value represented by formula (1) is in the range of 0.03 to 1.5:

$$\text{Z value} = ([\%\,Co]+1.5[\%\,V]+4.8[\%\,W]) \quad (1)$$

wherein [%Co], [% V], [% W], respectively, represent Co, V, and W contents by mass percent.

3. The corrosion-resistant chromium steel for architectural and civil engineering structural elements according to claim 2, wherein the Cr content is in the range of more than about 5 mass percent to less than about 7.5 mass percent and the W content is in the range of about 0.005 to about 0.03 mass percent.

4. The corrosion-resistant chromium steel for architectural and civil engineering structural elements according to claim 1, further comprising at least one of about 3.0 mass percent or less of Cu and about 3.0 mass percent or less of Mo.

5. The corrosion-resistant chromium steel for architectural and civil engineering structural elements according to claim 1, wherein a tensile strength of the steel is between 400 and 550 MPa.

6. The corrosion-resistant chromium steel for architectural and civil engineering structural elements according to claim 2, further comprising at least one of about 3.0 mass percent or less of Cu and about 3.0 mass percent or less of Mo.

7. The corrosion-resistant chromium steel for architectural and civil engineering structural elements according to claim 1, further comprising from about 0.0002 to about 0.0030 mass percent of B.

8. The corrosion-resistant chromium steel for architectural and civil engineering structural elements according to claim 2, further comprising from about 0.0002 to about 0.0030 mass percent of B.

9. The corrosion-resistant chromium steel for architectural and civil engineering structural elements according to claim 3, further comprising from about 0.0002 to about 0.0030 mass percent of B.

10. The corrosion-resistant chromium steel for architectural and civil engineering structural elements according to claim 4, further comprising from about 0.0002 to about 0.0030 mass percent of B.

* * * * *